US007293585B2

(12) United States Patent
Mahoney

(10) Patent No.: US 7,293,585 B2
(45) Date of Patent: Nov. 13, 2007

(54) BULK BAG UNLOADING APPARATUS

(75) Inventor: William J. Mahoney, Williamsport, PA (US)

(73) Assignee: The Young Industries, Inc., Muncy, IN (US)

( * ) Notice: Subject to any disclaimer, the term of this patent is extended or adjusted under 35 U.S.C. 154(b) by 0 days.

(21) Appl. No.: 11/320,573

(22) Filed: Dec. 30, 2005

(65) Prior Publication Data

US 2007/0151625 A1 Jul. 5, 2007

(51) Int. Cl.
*B65B 1/04* (2006.01)

(52) U.S. Cl. ..... 141/114; 141/391; 222/181.2; 414/403

(58) Field of Classification Search ..... 141/65, 141/67, 98, 114, 391; 222/181.2, 185.1, 222/105; 414/403, 404
See application file for complete search history.

(56) References Cited

U.S. PATENT DOCUMENTS 4,998,991 A * 3/1991 Poulton ..... 222/181.3
5,531,360 A * 7/1996 Berdel et al. ..... 222/185.1
5,944,070 A * 8/1999 Schmidt et al. ..... 141/114
5,947,333 A * 9/1999 Hoffmann et al. ..... 222/105
6,227,408 B1 * 5/2001 Poulton ..... 222/1
6,666,573 B2 * 12/2003 Grassi ..... 366/26
6,923,340 B2 * 8/2005 Ambs ..... 222/105
7,063,493 B2 * 6/2006 Pfeiffer et al. ..... 414/412

* cited by examiner

*Primary Examiner*—Steven O. Douglas
(74) *Attorney, Agent, or Firm*—Stevens, Davis, Miller & Mosher, LLP

(57) ABSTRACT

An apparatus for unloading a comminuted material contained in a bag having means disposed at an upper end portion thereof for suspending the bag and a closable discharge outlet disposed at a lower end thereof generally consisting of a support means; and a hopper having an upper inlet functional for receiving the closable discharge spout portion of the bag when the bag is disposed in a suspended position above the hopper, a lower outlet communicable with a material conveying means, a side opening through which an operator may obtain access to a lower end of the bag inserted into the hopper, and a baffle extending downwardly and transversely from a wall section of the hopper, from and below the access opening, toward and short of a hopper wall disposed opposite the hopper wall provided with the access opening, providing a flow path of material introduced into the hopper for the hopper outlet.

19 Claims, 1 Drawing Sheet

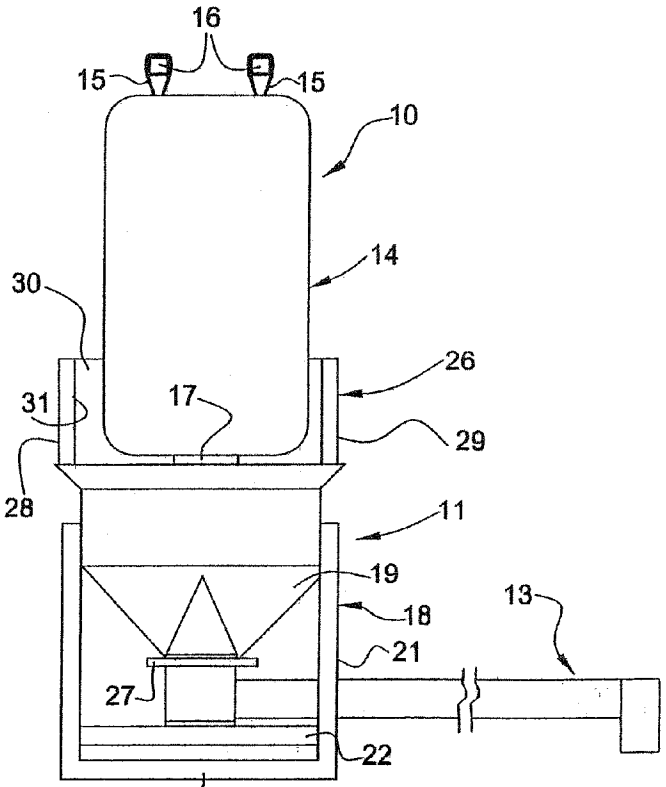
FIG. 2
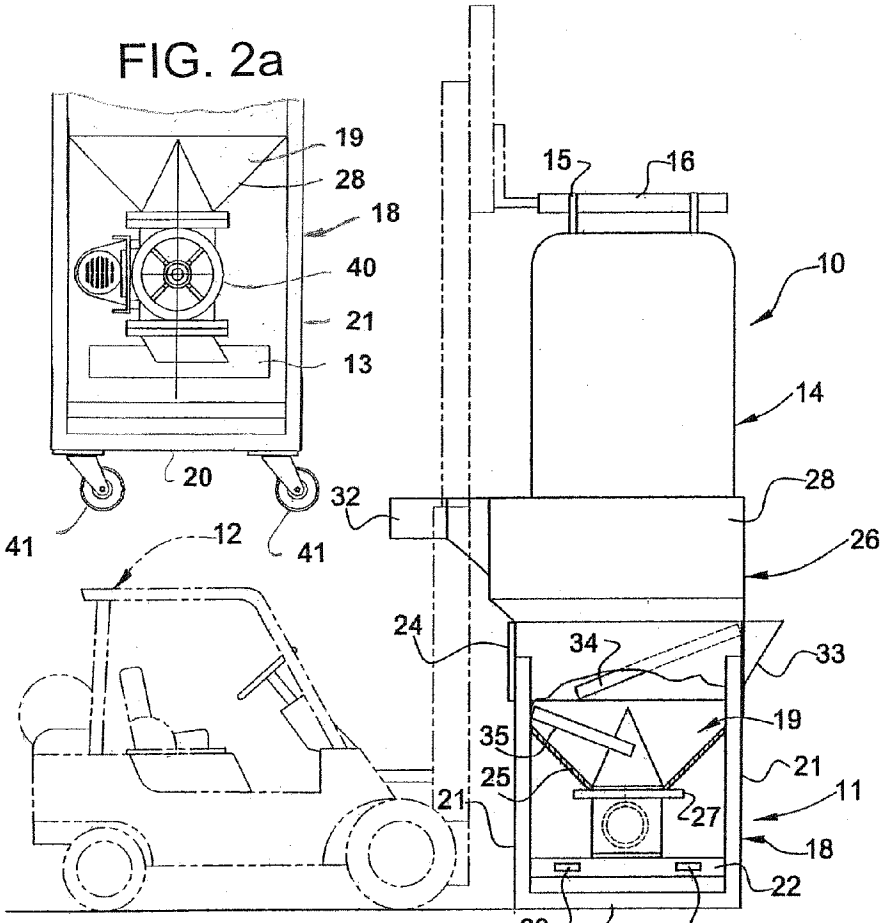
FIG. 1
FIG. 2a

BULK BAG UNLOADING APPARATUS

This invention relates to a material unloading apparatus and more particularly to an apparatus for unloading powdered materials contained in bulk bags.

BACKGROUND OF THE INVENTION

In various operations involving the processing or otherwise handling of powdered materials, such materials commonly have been stored and transported in bulk bags which are adapted to be emptied into various types of hoppers. Typically, such bags are equipped with a set of straps at an upper end thereof which may be connected to the blades of a forklift truck or another lifting and transporting device, and a spout at a lower end thereof which may be closed to contain the material within the bag and opened to unload the material. Various means have been employed for closing such spouts. They may be folded closed and maintained in the closed position by a flap, commonly referred to as a"diaper," overlying the folded spout and releasably secured to the main body portion of the bag, or simply may be releasably tied closed. Such hoppers can be of a variety of configurations, each having an upper inlet in which the lower end of a bag may be positioned and the spout thereof opened to permit the gravity flow of material into the hopper, and a lower outlet often communicable with a material conveying means such as a mechanical or pneumatic conveyor.

In the use of such arrangements of components, it has been the practice to position the bag in a suspended position with the lower end thereof disposed above the hopper, and then have operator reach under the suspended bag to release the spout and thus permit the material in the bag to gravity flow through the spout into the hopper. In such operation, however, it has been found that the operator reaching beneath the suspended bag and manually releasing the spout of the bag from the folded, closed position not only places the operator at risk of physical injury but exposes him to the hazardous effects of dust created by the material flowing out of the bag and into the hopper. In addition, it has been found that the use of such prior art unloading methods and equipment has been inefficient, resulting in a loss of production. Accordingly, it is the principal object of the present invention to provide an improved apparatus for unloading powdered materials from a bulk bag which is safe to handle, less polluting of the ambient atmosphere and more productive in use.

SUMMARY OF THE INVENTION

The principal object of the present invention is achieved by providing an apparatus for unloading a powdered material contained in a bulk bag having means disposed at an upper end portion thereof for suspending the bag and a closable discharge spout portion disposed at a lower end thereof, generally consisting of a support means; and a hopper supported on such support means, having an upper inlet for receiving the closable discharge spout portion of the bag when the bag is disposed in a suspended position above the hopper, a lower outlet communicable with a material conveying means, a side opening through which an operator may obtain access to the lower end of the bag inserted into the hopper, permitting an operator to reach into the hopper and release and thus open the spout of the bag, and an inclined baffle disposed in the hopper, extending downwardly and transversely from a wall section of the hopper, below the access opening, toward and spaced from a hopper wall section disposed oppositely of the hopper wall provided with the access opening, providing a flow path of material introduced into the hopper toward the hopper outlet. Preferably, the hopper includes an outer, imperforate wall and an inner perforate wall defining a fluid chamber, wherein the fluid chamber is communicable with a dust collection system. In addition, the hopper preferably includes second inclined baffle disposed below such first mentioned baffle, extending downwardly and transversely from such oppositely disposed wall section, toward and short of such first hopper wall section, providing a flow path of material received from the first mentioned baffle toward the hopper outlet.

BRIEF DESCRIPTION OF THE DRAWINGS

FIG. 1 is a side elevational view an apparatus embodying the present invention, having a portion thereof broken away and illustrating the manner in which a bulk bag may be positioned relative to the apparatus for unloading the contents of the bag;

FIG. 2 is a front elevational view of the apparatus shown in FIG. 1; and FIG. 2*a* is a front elevational view of an apparatus similar to the apparatus shown in FIG. 2. having a portion thereof broken away and illustrating a modification thereof.

DETAILED DESCRIPTION OF THE PREFERRED EMBODIMENT OF THE INVENTION

Referring to FIGS. 1 and 2 of the drawings, there is illustrated a bulk bag 10 containing a powdered material to be unloaded, an unloading apparatus 11 embodying the present invention, a forklift truck 12 operable to position the bulk bag relative to the unloading apparatus for unloading the contents of the bag and a material conveying apparatus 13 operatively connected to the unloading apparatus. Bulk bag 10 consists of a main body portion 14 formed of a flexible but sturdy material which holds the material to be unloaded, a set of straps 15 at an upper end thereof which may be engaged by the blades 16 of the forklift truck for lifting, lowering, transporting and positioning bag 14 for unloading as shown in FIG. 1 and a spout portion 17 disposed at a lower end thereof. The spout may be tied shut and folded against and secured to the lower end of main body portion 14 of the bag, folded against the underside of the main body portion of the bag and secured thereto by means of a flap commonly referred to as a "diaper" or may be releasably closed and secured to the underside of the main body portion of the bag by any other suitable means.

Unloading apparatus 11 generally consists of a support frame 18 and a hopper 19 supported on the support frame. The support frame includes a base member 20 and a set of upstanding members 21. Supported by members 21 and spaced from base member 20 is a crosspiece member 22 provided with a pair of parallel slots 23 which are adapted to receive blades 16 of the forklift truck for lifting, lowering and transporting the apparatus. Alternatively, the apparatus may be provided with a set of wheels to permit it to be moved from site to site.

Hopper 19 includes an upper section 24 supported on the support frame, a lower section 25 depending from the upper section and a hood section 26 disposed on upper section 24. Lower hopper section 25 is formed with a set of converging plate portions resembling an inverted, pyramid providing an outlet having a flange secured to a flange 27 provided at the inlet of conveying apparatus 13. The conveying apparatus may consist of a mechanical, pneumatic or other form of conveying mechanism. In addition, a feed valve may be provided between lower hopper section 25 and the inlet of conveying apparatus 13 including a rotary valve or an air lock.

The upper end of upper hopper section 24 is open and supports hood 26 which has a U-shaped configuration including a pair of parallel wall sections 28 and 29 joined by a wall section 30 providing a side opening 31. Each of wall sections 28 through 30 includes an outer imperforate wall portion and an inner perforate wall section spaced form the outer wall section, providing a fluid chamber provided with a vent connection 32 connectable to a dust control system. Formed along the open side 31 of the hood is a ledge 33.

As best shown in FIG. 1, the interior of hopper 25 is provided with an upper baffle 34 and a lower baffle 35. Upper baffle 34 is inclined downwardly and transversely from a side wall portion of upper hopper section 24 and extends short of an opposite wall of upper hopper section 24. Lower baffle 35 is inclined downwardly and transversely from a wall portion of lower hopper section 25, extending toward and short of the opposed wall portion of hopper section 25. The upper surfaces of upper and lower baffles 34 and 35 are substantially planar to permit material deposited on upper baffle 34 to flow along upper baffle 34 onto baffle 35 and then be directed to the outlet of the lower hopper section. Such surfaces also may be curved in a transverse direction relative to the lengths.

In the use of the unloading apparatus as described, forklift truck 12 is operated to engage bulk bag 14 containing a powdered material to be unloaded, by inserting blades 16 thereof through lifting straps 15, lift the bag clear of the ground, transport the bag to the site of the unloading apparatus and position it above hopper 19 and then lower the bag within the confines of hood 26 as shown in FIGS. 1 and 2. The dust collection system is then activated along with conveying system 13. With the bag thus positioned and the dust collection and conveying systems activated, the operator standing alongside the apparatus reaches through the open side of the hood and under the suspended bag to release and unfold the spout thus permitting material within the bag to gravity flow into the hopper. Material deposited into the hopper is then caused to flow along upper baffle 34, onto lower baffle 35 and be directed to the outlet of the hopper to be removed and transported by the conveying system. Dust generated by the flow of material from the bag into the hopper is drawn through the inner perforate surfaces of hood 26 and removed by the dust control system.

After the spout has been released and extends, the operator may then adjust the height of the bulk bag so that the spout's open end rests on the upper baffle surface. The discharge rate of the material may be controlled by controlling the distance of the spout above the upper inclined baffle as well as air flow to the hopper walls.

The apparatus as described is particularly effective in unloading cohesive powders, pigments and other fine materials which are not free flowing and do not flush when supplied with slight aeration. Pellets or granular materials also work well with such apparatus.

By providing an open side in hood 26 at a height convenient to the operator, allowing the operator to easily reach under the suspended bag, and operating the dust collection system, the operator may quickly and safely release the spout of the bag and not be subjected to inhalation of any of the dust generated by the flow of material from the bag into the hopper.

Once the bag has been completely unloaded, the forklift truck may be operated to lift the empty bag out of the apparatus and be transported to another site. In the event it is desired to relocate the apparatus to a different site, the dust collection system and the conveying system may be disconnected from the apparatus, the forklift truck may be utilized to insert the blades thereof in blade receiving slots 23, 23, lift, transport and lower the apparatus at the new site and the dust collection and conveying systems may be reconnected to render the apparatus operational again. In addition to a forklift, any other lifting device may be used to lift and lower the bag including a chain hoist and the like.

The lower baffle serves as a safety barrier preventing any operator from reaching down and contacting any valves provided at the discharge end of the hopper.

In addition to the hood section of the hopper having an outer imperforate wall and an inner perforate wall providing a chamber communicable with the dust collection system, the other sections of the hopper may similarly be formed to enhance the dust collection. Alternatively, fluidizing air may be supplied to the lower component sections of the hopper to enhance the flowability of material through the lower end of the hopper and into the inlet of the conveying system.

FIG. 2*a* illustrates an apparatus similar to the apparatus shown in FIGS. 1 and 2 but modified in that it includes an airlock or feeder valve 40 interposed between hopper 19 and the inlet of conduit 13. When an airlock is provided between the hopper and the conveying conduit, material gravity flows through the airlock into the conveyor and the airlock serves to isolate the conveyor from the hopper. When a feeder valve is provided, the material similarly is fed into the conveyor but assisted by the rotation of the rotor of the valve. Furthermore, in lieu of providing a pair of openings accommodating the blades of forklift truck for transporting such apparatus from one site to another, such apparatus is provided with a set of wheels 41, permitting the apparatus to be rolled from one site to another. In all other respects, the apparatus shown in FIG. 2*a* is constructed and operates similarly to the construction and operation of the apparatus shown in FIGS. 1 and 2.

It will be appreciated that the apparatus as described provides a simple yet effective piece of equipment for conveniently and safely unloading powdered materials from bulk bags. The open side of the hood section of the hopper disposed at a convenient height permits the operator to safely and quickly reach under the suspended bag to release the spout of the bag, and the dust collection system allows him to do so without the risk of inhaling the dust generated by the material flowing out of the bag.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. An apparatus for unloading a comminuted material contained in a bag having means disposed at an upper end portion thereof for suspending said bag and a closable discharge spout portion disposed at a lower end thereof, comprising:

a support means; and a hopper supported on said support means having an upper inlet functional to receive said closable discharge spout portion of said bag when said bag is disposed in a suspended position above said hopper, a lower outlet communicable with a material conveying means, a side opening through which an operator may obtain access to a lower end of said bag inserted into said hopper, and a first inclined baffle disposed in said hopper, extending downwardly and transversely from a wall section of said hopper, from and below said side opening, toward and short of a hopper wall disposed opposite the hopper wall provided with said side opening, providing a flow path of material introduced into said hopper toward said hopper outlet.

2. An apparatus according to claim 1 wherein said hopper is provided with a section including an outer imperforate wall and an inner perforate wall defining a fluid chamber, and wherein said fluid chamber is communicable with a dust collection system.

3. An apparatus according to claim 1 wherein said hopper includes an upper section including said side opening and a lower section having at least one converging wall portion.

4. An apparatus according to claim 3 wherein said hopper is provided with a section including an outer imperforate wall and an inner perforate wall defining a fluid chamber, and wherein said fluid chamber is communicable with a dust collection system.

5. An apparatus according to claim 3 wherein said lower hopper section has an inverted, substantially pyramidal configuration.

6. An apparatus according to claim 5 wherein said hopper is provided with a section including an outer imperforate wall and an inner perforate wall defining a fluid chamber and wherein said fluid chamber is communicable with a dust collection system.

7. An apparatus according to claim 1 wherein said inclined baffle is provided with a planar surface on which material unloaded into said hopper impinges and is directed downwardly and transversely.

8. An apparatus according to claim 1 wherein said inclined baffle is provided with a surface curved transversely relative to the length thereof on which material unloaded into said hopper impinges and is directed downwardly and transversely.

9. An apparatus according to claim 1 including a second inclined baffle disposed in said hopper, below said first inclined baffle, extending downwardly and transversely from said oppositely disposed hopper wall, toward and short of said hopper wall section including said side opening, providing a flow path of material received from said first inclined baffle toward said hopper outlet.

10. An apparatus according to claim 9 wherein said hopper is provided with a section including an outer imperforate wall and an inner perforate wall defining a fluid chamber, and wherein said fluid chamber is communicable with a dust collection system.

11. An apparatus according to claim 9 wherein said hopper includes an upper section including said access opening and a lower section having at least one converging wall portion.

12. An apparatus according to claim 1 wherein said hopper includes an outer imperforate wall and an inner perforate wall defining a fluid chamber, and wherein said fluid chamber is communicable with a dust collection system.

13. An apparatus according to claim 12 wherein said hopper includes an upper section including said access opening and a lower section having at least one converging wall portion.

14. An apparatus according to claim 9 wherein said inclined baffle is provided with a surface curved transversely relative to the length thereof on which material unloaded into said hopper impinges and is directed downwardly and transversely.

15. An apparatus according to claim 1 including a valve communicating with said hopper outlet and communicable with said conveying means.

16. An apparatus according to claim 15 wherein said valve comprises a rotary valve.

17. An apparatus according to claim 15 wherein said valve comprises an air lock.

18. An apparatus according to claim 1 wherein said support means includes a pair of slots for receiving the blades of a forklift truck for lifting, transporting and lowering said apparatus.

19. An apparatus according to claim 1 wherein said support means includes wheel units rendering said apparatus mobile.

* * * * *